US008002370B2

(12) United States Patent
Shoji

(10) Patent No.: US 8,002,370 B2
(45) Date of Patent: Aug. 23, 2011

(54) SERIAL DATA TRANSFER METHOD, ELECTRIC DEVICE, AND PRINTING APPARATUS

(75) Inventor: Michiharu Shoji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 656 days.

(21) Appl. No.: 11/091,585

(22) Filed: Mar. 29, 2005

(65) Prior Publication Data

US 2005/0225576 A1 Oct. 13, 2005

(30) Foreign Application Priority Data

Apr. 7, 2004 (JP) ..... 2004-113214

(51) Int. Cl.
*B41J 29/38* (2006.01)

(52) U.S. Cl. ..... 347/5; 347/9; 347/12

(58) Field of Classification Search ..... 347/5, 9, 347/12

See application file for complete search history.

(56) References Cited

U.S. PATENT DOCUMENTS

2002/0118241 A1* 8/2002 Fujii ..... 347/12
2003/0142153 A1* 7/2003 Nakajima et al. ..... 347/9
2004/0046854 A1* 3/2004 Omae ..... 347/132

FOREIGN PATENT DOCUMENTS

JP 04-101535 A 4/1992
JP 07-230418 A 8/1995
JP 07-246723 A 9/1995
JP 8-130621 5/1996
JP 08-265168 A 10/1996
JP 9-207369 8/1997
JP 2001-223596 8/2001

OTHER PUBLICATIONS

Office Action in Japanese Pat. App. No. 2004-113214, Japanese Patent Office, Mar. 12, 2010.

* cited by examiner

*Primary Examiner* — Matthew Luu
*Assistant Examiner* — Jannelle M Lebron
(74) *Attorney, Agent, or Firm* — Fitzpatrick, Cella, Harper & Scinto

(57) ABSTRACT

Serial data transfer method, electric device and printing apparatus for enabling various controls without adding signal lines and control signals to serial data transfer utilizing, e.g., three signal lines for transferring a data signal, a clock signal, and a strobe signal. According to this method, when a data signal, which is supplied from a first electric device to a second electric device using a first signal line, is serially transferred from the first electric device to the second electric device in synchronization with a clock signal which is similarly supplied through a second signal line, the data signal is inputted to a shift register of the second electric device in synchronization with the clock signal, and the data signal inputted to the shift register is captured by plural latches of the second electric device utilizing at least one of the control signal supplied from the first electric device to the second electric device using a third signal line, a signal level of the data signal, and a signal level of the clock signal.

11 Claims, 13 Drawing Sheets

SERIAL DATA TRANSFER METHOD, ELECTRIC DEVICE, AND PRINTING APPARATUS

FIELD OF THE INVENTION

This invention relates to a serial data transfer method, an electric device, and a printing apparatus, and more particularly, to a serial data transfer method, an electric device, and a printing apparatus that are applied to data transfer in a printing apparatus comprising an inkjet printhead.

BACKGROUND OF INVENTION

Conventionally, parallel data transfer has been employed for multi-bit data transfer. In parallel data transfer, multi-bit data is concurrently transferred using plural signal lines, each of which is assigned to each of the multiple bits. However, when the number of bits in the concurrent transfer increases to, e.g., 8 bits, 16 bits, 32 bits, and 64 bits, it causes a problem of an increased number of data signal lines in the parallel transfer. In view of this, serial data transfer, in which data transferred while being shifted in synchronization with a clock signal is enabled by a strobe signal, has come into use.

Taking, for example, a printing apparatus which performs printing by reciprocally scanning an inkjet printhead (hereinafter referred to as the printhead) mounted to a carriage, various control signals and data signals are transmitted or received between the printhead and the printer main unit through a flexible printer cable (FPC) that connects the carriage and the printer main unit. For the data transfer between the printhead and the printer main unit, the serial transfer method is adopted.

Furthermore, such a printing apparatus comprises a carriage motor for driving a carriage, a conveyance motor for conveying a printing medium such as printing paper, and various other motors. These motors are driven by motor drivers. For transferring motor driving signals from the control circuits of the printing apparatus to the motor drivers, the serial transfer method is also adopted. Since the types and driving methods of the various motors are different in accordance with their usage, different types and different numbers of control signals are transferred to respective motor drivers, and the motor drivers are required to execute motor driving control. For this reason, conventionally, dedicated motor drivers corresponding to respective motors are provided to individually perform motor driving control.

Furthermore, in a case of transferring data in accordance with plural different factors, there has been a method proposed to realize data transfer where a data signal, a clock signal, and a strobe signal are assigned for each factor, and a control signal is added for switching over between the factors.

For instance, Japanese Patent Application Laid-Open (KOKAI) No. 8-130621 and No. 9-207369 disclose such technique.

Moreover, Japanese Patent Application Laid-Open (KOKAI) No. 2001-223596 proposes execution of data transfer at the rising edge of a strobe signal.

However, assume that the above-described conventional serial transfer method is applied to the data transfer between the control circuits and the motor drivers of the aforementioned printing apparatus. Under ordinary circumstances, the serial data transfer can be realized by three signal lines respectively supplying three signals: a clock signal, a data signal, and a strobe signal. However, for instance, when more than three signal lines become necessary due to the increased types and numbers of motors, the number of signal lines naturally increases. Along with the increase, it becomes necessary to largely change the specification of the printing apparatus, e.g., providing new signal pads for the control circuits and motor drivers, enlarging the layout area of the circuit board for arranging the increased number of serial signal lines on the control circuits, and so forth.

In addition, if dedicated motor drivers corresponding to various motors provided in the printing apparatus are used for individual motor driving control as has been adopted conventionally, different types of motor drivers become necessary, and the cost for developing such motor drivers becomes extremely high. On the other hand, there are demands for reducing the development cost arising from the different driving methods and types of motors as well as the increased number of signals.

Furthermore, assuming that the above-described conventional serial transfer method is applied to the data transfer between the printhead and the head driver of the aforementioned printing apparatus, if the number of signals larger than the conventionally used number becomes necessary due to increased functions of the printhead, the number of signal lines naturally increases. Along with the increase, a change in the specification becomes necessary, e.g., providing new signal pads in the printhead, increasing pins and pads for electric connections in the carriage, enlarging the width of the flexible printer cable (FPC), increasing the number of connection pins in the printhead interface of the head driver IC which is provided in the printer main unit for driving the printhead, and so forth.

Therefore, if the number of signal lines increases due to the increased functions of the printhead, it becomes necessary to change the specification and add functions of the head driver that drives the printhead. This leads to upsizing of a driver IC that realizes the head driver, resulting in an increased production cost of the overall printing apparatus.

As described above, in a case of applying serial data transfer to an inkjet printing apparatus, an increase in the number of signal lines gives impact in various aspects.

Meanwhile, the demands for adding functions in the printing apparatus and/or the printhead is a trend of the times. Also, developing and providing high-performance printers and printheads that meet various market demands are requirements that should be considered.

In view of the above, although the increased number of signals is inevitable to realize advanced functions of a printing apparatus or a printhead, it is required to realize serial data transfer while suppressing an increase in the number of signal lines.

SUMMARY OF THE INVENTION

Accordingly, the present invention is conceived as a response to the above-described disadvantages of the conventional art.

For example, a serial data transfer method, an electric device and a printing apparatus according to the present invention are capable of performing various controls without adding signal lines or control signals to serial data transfer that utilizes three signal lines for transferring, e.g., a data signal, a clock signal, and a strobe signal.

According to one aspect of the present invention, preferably, there is provided a serial data transfer method of serially transferring a data signal from a first electric device to a second electric device in synchronization with a clock signal, the data signal being supplied from the first electric device to the second electric device using a first signal line and the clock signal being supplied from the first electric device to the second electric device using a second signal line, comprising: an input step of inputting the data signal to a shift register of the second electric device in synchronization with the clock signal; and a capturing step of capturing the data signal, inputted to the shift register in the input step, by a plurality of latches of the second electric device utilizing at least one of a control signal supplied from the first electric device to the second electric device using a third signal line, a signal level of the data signal, and a signal level of the clock signal.

According to another aspect of the present invention, preferably, there is provided an electric device for serially receiving a data signal supplied from an external device using a first signal line in synchronization with a clock signal supplied from the external device using a second signal line, comprising: a shift register for inputting the data signal in synchronization with the clock signal; a plurality of latches for latching the data signal inputted to the shift register; and a capture control circuit for capturing the data signal, inputted to the shift register, by the plurality of latches utilizing at least one of a control signal supplied from the external device using a third signal line, a signal level of the data signal, and a signal level of the clock signal.

More specifically, the capturing control is preferably realized as follows.

(1) The capturing control circuit performs control in such a way that the data signal inputted to the shift register is selectively captured by a first latch or a second latch of the plurality of latches based on the control signal and a signal level change in the data signal after the data signal has been inputted.

(2) The capturing control circuit performs control in such a way that the data signal inputted to the shift register is selectively captured by a first latch or a second latch of the plurality of latches based on the control signal and a signal level change in the clock signal after the data signal has been inputted.

(3) The capturing control circuit performs control in such a way that the data signal inputted to the shift register is selectively captured by a first latch, a second latch, a third latch, or a fourth latch of the plurality of latches based on the control signal, a signal level change in the data signal after the data signal has been inputted, and a signal level change in the clock signal.

(4) A second shift register for inputting the data signal in synchronization with the clock signal is further provided. The capture control circuit performs control in such a way that the data signal, supplied from the first signal line, is inputted to the shift register or the second shift register in accordance with the control signal, and in accordance with a control signal further inputted upon the data signal input, the capture control circuit performs control in such a way that the data signal inputted to the shift register or the second shift register is selectively captured by the first latch or the second latch of the plurality of latches.

According to still another aspect of the present invention, preferably, there is provided a printing apparatus incorporating the above described electric device, comprising: scanning means for reciprocally scanning a printhead that performs printing on a print medium, feed means for feeding the print medium into the apparatus; conveyance means for conveying the print medium according to a progress of printing operation; discharge means for discharging the print medium outside the apparatus upon completion of the printing operation; maintenance means for maintaining excellent operation of the printhead; driving means for supplying driving force for respectively driving the scanning means, the feed means, the conveyance means, the discharge means, and the maintenance means; driving control means for controlling the driving means; and control means for controlling overall operation of the apparatus, wherein the electric device is incorporated as part of the driving control means, and a driving control data signal, used by the driving control means, is supplied to the electric device by serial transfer from the control means.

Note that the driving means includes: (1) a carriage motor for driving a carriage incorporating the printhead and causing reciprocal movement; (2) a feed motor for feeding the print medium into the apparatus; (3) a conveyance motor for conveying the print medium; (4) a discharge motor for discharging the print medium outside the apparatus; and (5) a maintenance motor for performing recovery, cleaning, and capping of the printhead.

Furthermore, as a specific example of application, it is preferable that the driving control means is a motor driver, the control means includes an ASIC, and a motor driving data signal is serially transferred from the ASIC to the motor driver.

The invention is particularly advantageous since it is possible to realize various data capturing control, without increasing the number of signal lines, by effectively utilizing serially transferred signals that are respectively transferred using the first to third signal lines.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

<Description of Inkjet Printing Apparatus (FIG. 1)>

Figure 1:
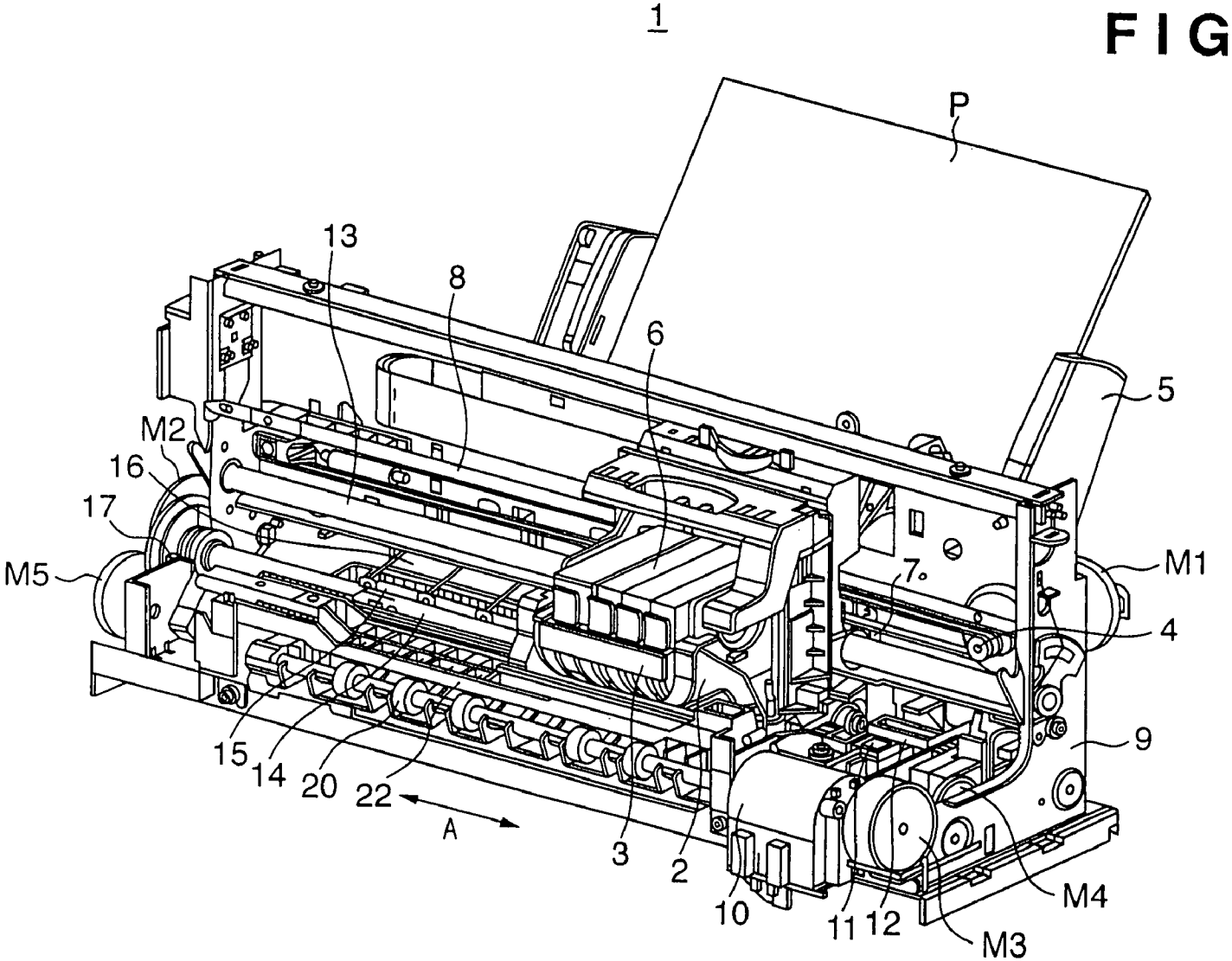
FIG. 1 is a perspective view showing an external appearance of an overall configuration of an inkjet printing apparatus which is a typical embodiment of the present invention.

FIG. 1 is a perspective view showing an external appearance of an overall configuration of an inkjet printing apparatus 1 which is a typical embodiment of the present invention.

The inkjet printing apparatus 1 (hereinafter referred to as the printer) shown in FIG. 1 performs printing in the following manner. Driving force generated by a carriage motor M1 is transmitted from a transmission mechanism 4 to a carriage 2 incorporating a printhead 3, which performs printing by discharging ink in accordance with an inkjet method, and the carriage 2 is reciprocally moved in the direction of arrow A. A printing medium P, e.g., printing paper, is fed by a sheet-feeding mechanism 5 driven by a sheet-feeding motor M4 and conveyed to a printing position, and ink is discharged by the printhead 3 at the printing position of the printing medium P, thereby realizing printing.

To maintain an excellent state of the printhead 3, the carriage 2 is moved to the position of a recovery device 10, and discharge recovery processing of the printhead 3 is intermittently performed.

In the carriage 2 of the printer 1, not only the printhead 3 is mounted, but also an ink cartridge 6 reserving ink to be supplied to the printhead 3 is mounted. The ink cartridge 6 is attachable to or detachable from the carriage 2.

The printer 1 shown in FIG. 1 is capable of color printing. Therefore, the carriage 2 holds four ink cartridges respectively containing magenta (M), cyan (C), yellow (Y), and black (K) inks. These four cartridges are independently attachable/detachable.

Appropriate contact between the junction surfaces of the carriage 2 and the printhead 3 can achieve necessary electrical connection. By applying energy to the printhead 3 in accordance with a printing signal, the printhead 3 selectively discharges ink from plural discharge orifices, thereby performing printing. In particular, the printhead 3 according to this embodiment adopts an inkjet method which discharges ink by utilizing heat energy, and comprises electrothermal transducers for generating heat energy. Electric energy applied to the electrothermal transducers is converted to heat energy, which is then applied to ink, thereby creating film boiling. This film boiling causes growth and shrinkage of a bubble in the ink, and generates a pressure change. By utilizing the pressure change, ink is discharged from the discharge orifices. The electrothermal transducer is provided in correspondence with each discharge orifice. By applying a pulsed voltage to the corresponding electrothermal transducer in accordance with a printing signal, ink is discharged from the corresponding discharge orifice.

As shown in FIG. 1, the carriage 2 is connected to part of a driving belt 7 of the transmission mechanism 4 which transmits driving force of the carriage motor M1, and is slidably supported along a guide shaft 13 in the direction of arrow A. Therefore, the carriage 2 reciprocally moves along the guide shaft 13 in accordance with normal rotation and reverse rotation of the carriage motor M1. In parallel with the moving direction of the carriage 2 (direction of arrow A), a scale 8 is provided to indicate an absolute position of the carriage 2. In this embodiment, the scale 8 is a transparent PET film on which black bars are printed in necessary pitches. One end of the scale 8 is fixed to a chassis 9, and the other end is supported by a leaf spring (not shown).

In the printer 1, a platen (not shown) is provided opposite to the discharge orifice surface where discharge orifices (not shown) of the printhead 3 are formed. As the carriage 2 incorporating the printhead 3 is reciprocally moved by the driving force of the carriage motor M1, a printing signal is supplied to the printhead 3 to discharge ink and printing is performed on the entire width of the printing medium P conveyed on the platen.

Furthermore, in FIG. 1, numeral 14 denotes a conveyance roller driven by a conveyance motor M2 for conveying the printing medium P. Numeral 15 denotes pinch roller that presses the printing medium P against the conveyance roller 14 by a spring (not shown). Numeral 16 denotes a pinch roller holder which rotatably supports the pinch roller 15. Numeral 17 denotes a conveyance roller gear fixed to one end of the conveyance roller 14. The conveyance roller 14 is driven by rotation of the conveyance motor M2 transmitted to the conveyance roller gear 17 through an intermediate gear (not shown).

Numeral 20 denotes a discharge roller for discharging the printing medium P, on which an image is formed by the printhead 3, outside the printer. The discharge roller 20 is driven by receiving rotation of a sheet-discharge motor M5. Note that the discharge roller 20 presses the printing medium P by a spur roller (not shown) that presses the printing medium by a spring. Numeral 22 denotes a spur holder which rotatably supports the spur roller.

Furthermore, as shown in FIG. 1, the printer 1 includes the recovery device 10 for recovering the printhead 3 from discharge failure, which is arranged at a desired position (e.g., a position corresponding to the home position) outside the reciprocal movement range for printing operation (outside the printing area) of the carriage 2 that incorporates the printhead 3.

The recovery device 10 comprises a capping mechanism 11 for capping the discharge orifice surface of the printhead 3, and a wiping mechanism 12 for cleaning the discharge orifice surface of the printhead 3. In conjunction with the capping operation of the capping mechanism 11, suction means (suction pump or the like) of the recovery device enforces ink discharge from the discharge orifices, thereby executing discharge recovery operation, that is, removing high-viscosity ink and bubbles in the ink channel of the printhead 3.

In addition, when printing operation is not performed, the discharge orifice surface of the printhead 3 is capped by the capping mechanism 11 for protecting the printhead 3 and preventing ink from evaporation and drying. The wiping mechanism 12 is arranged in the neighborhood of the capping mechanism 11 for wiping off an ink droplet attached to the discharge orifice surface of the printhead 3.

By virtue of the capping mechanism 11 and the wiping mechanism 12, a normal ink discharge condition of the printhead 3 can be maintained.

Driving force of the suction pump of the recovery device 10, the capping mechanism 11, and the wiping mechanism 12 is supplied by a maintenance motor M3.

<Control Structure of Inkjet Printing Apparatus (FIG. 2)>

Figure 2:
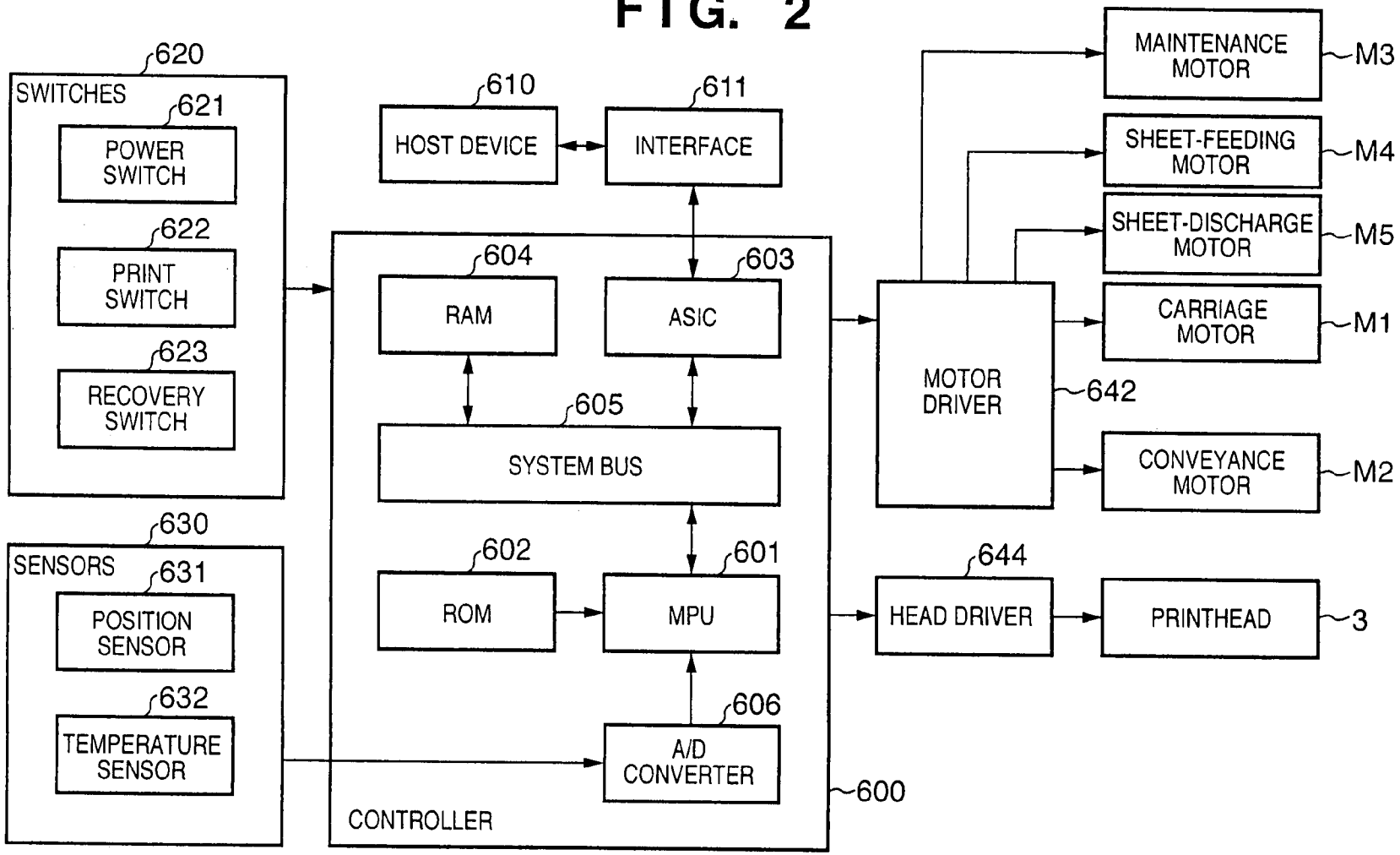
FIG. 2 is a block diagram showing a control structure of the printing apparatus shown in FIG. 1.

FIG. 2 is a block diagram showing a control structure of the printer shown in FIG. 1.

Referring to FIG. 2, a controller 600 comprises: an MPU 601; ROM 602 storing a program corresponding to the control sequence which will be described later, predetermined tables, and other fixed data; an Application Specific Integrated Circuit (ASIC) 603 generating driving data (DATA) of the printing elements (discharge heaters) for the printhead 3 while directly accessing the storage area of a RAM 604; RAM 604 providing an image data developing area or a working area for executing a program; a system bus 605 for mutually connecting the MPU 601, ASIC 603, and RAM 604 for data transmission and reception; and an A/D converter 606 performing A/D conversion on an analog signal inputted by sensors which will be described later and supplying a digital signal to the MPU 601.

In FIG. 2, numeral 610 denotes a computer serving as an image data supplying source (or an image reader, a digital camera or the like), which is generically referred to as a host unit. Between the host unit 610 and the printer 1, image data, commands, status signals and so forth are transmitted or received via an interface (I/F) 611.

Numeral 620 denotes switches for receiving commands from an operator, which includes a power switch 621, a print switch 622 for designating a print start, and a recovery switch 623 for designating a start of the processing (recovery processing) aimed to maintain an excellent ink discharge state of the printhead 3. Numeral 630 denotes sensors for detecting an apparatus state, which includes a position sensor 631 such as a photo-coupler for detecting a home position h, and a temperature sensor 632 provided at an appropriate position of the printer for detecting an environmental temperature.

Numeral 644 denotes a head driver which generates a control signal for driving the printhead 3 based on data from the ASIC 603. Numeral 642 denotes a motor driver which controls the carriage motor M1, the conveyance motor M2, the maintenance motor M3, the sheet-feeding motor M4, and the sheet-discharge motor M5 in accordance with printing operation.

Figure 3:
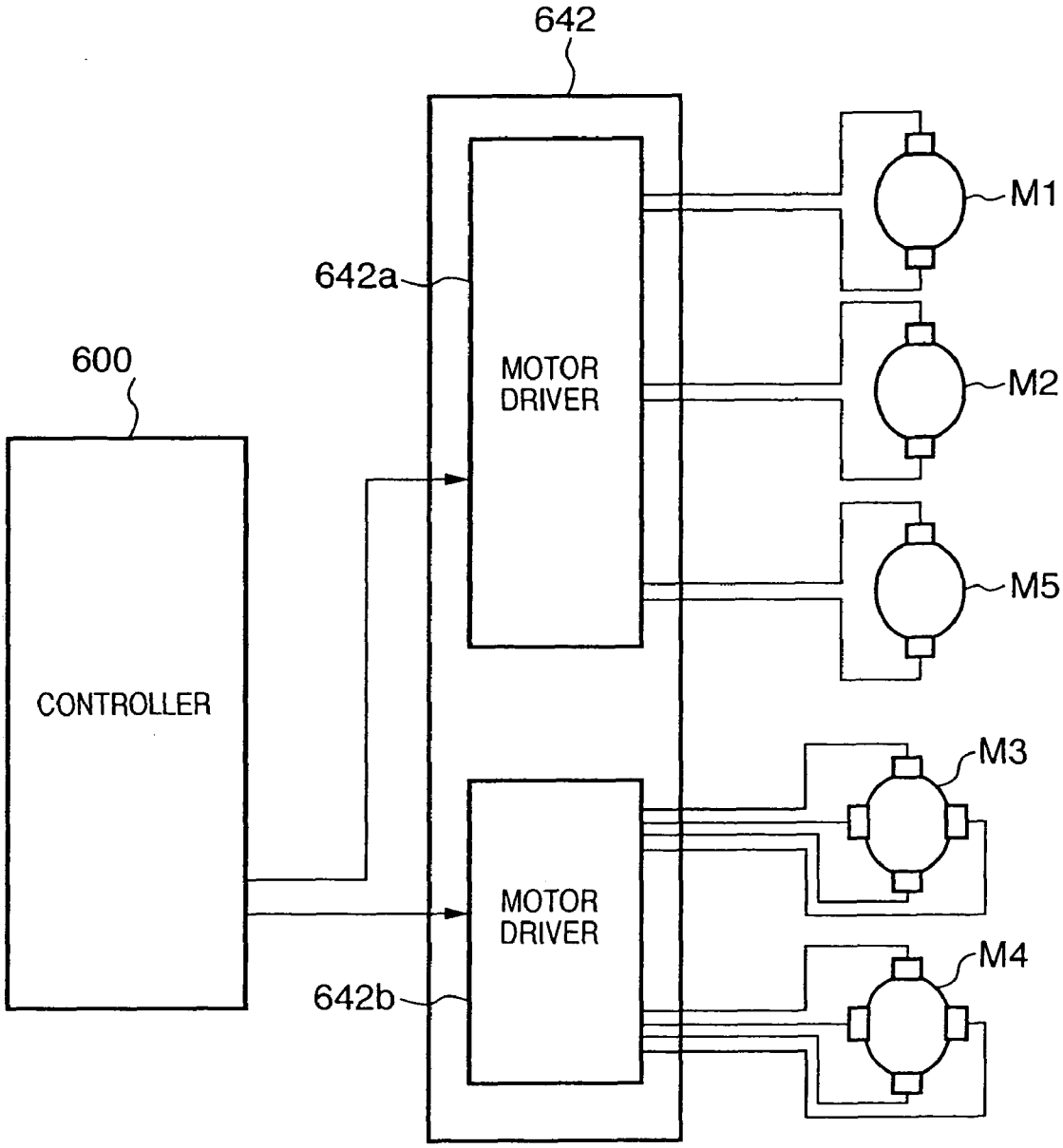
FIG. 3 is a block diagram showing relations between motor drivers and five motors.

FIG. 3 is a block diagram showing relations between the motor drivers and the five motors.

As described above with reference to FIGS. 1 and 2, the printer comprises five motors M1 to M5: three DC motors including the carriage motor M1, the conveyance motor M2, and the sheet-discharge motor M5, as well as two stepping motors including the maintenance motor M3 and the sheet-feeding motor M4.

As shown in FIG. 3, a motor driver 642 is constructed with a motor driver 642*a* for driving three DC motors M1, M2 and M5, and a motor driver 642*b* for driving two stepping motors. These two motor drivers basically have the same configuration.

Figure 4:
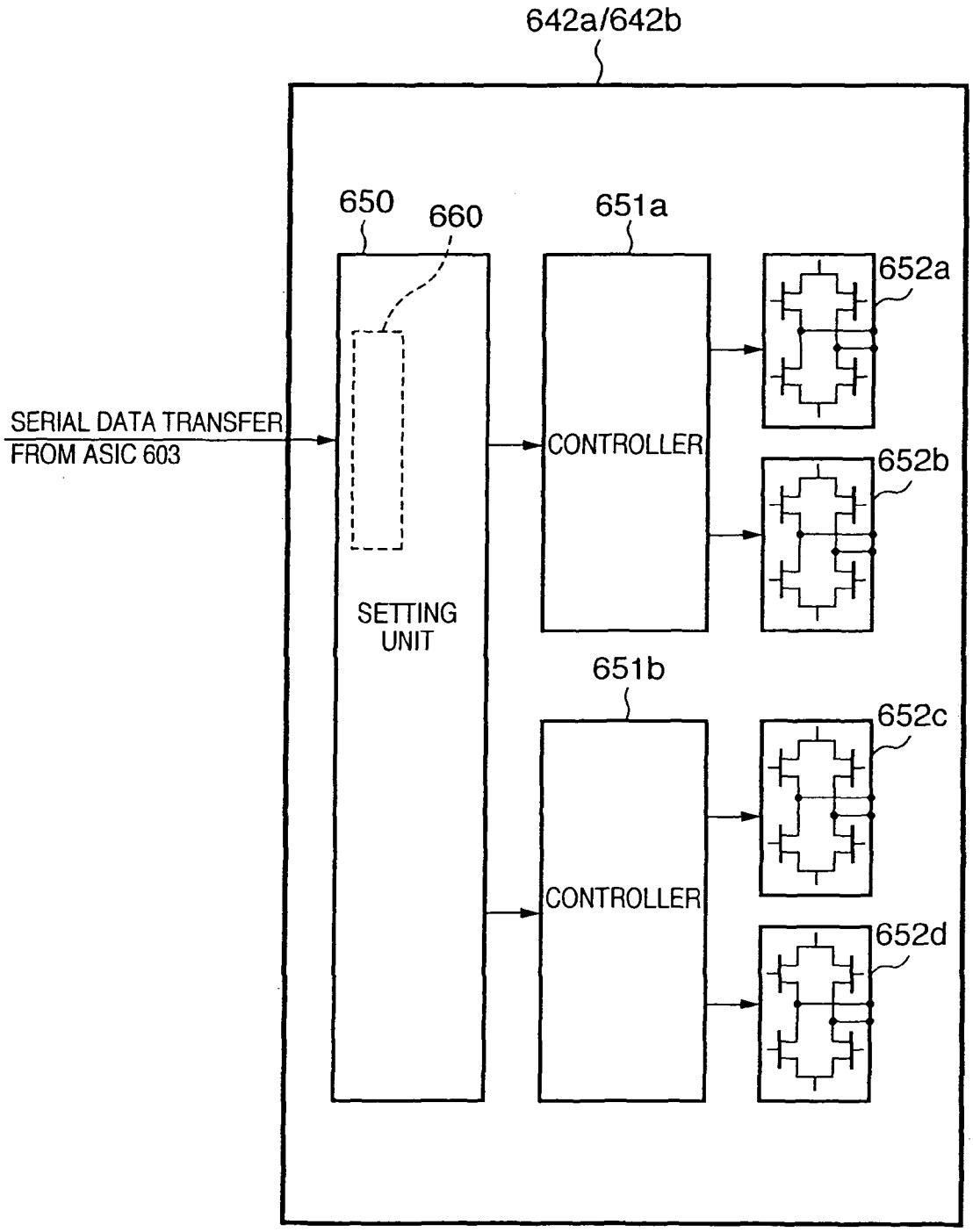
FIG. 4 is a diagram showing an internal configuration of a motor driver 642*a* (642*b*)

FIG. 4 is a diagram showing an internal configuration of the motor driver 642*a* (642*b*).

The motor driver is configured with, e.g., an integrated circuit (IC) of one chip. The motor driver shown in FIG. 4 comprises four H-bridge circuits 652*a* to 652*d*. A combination of the H-bridges can be changed in accordance with the type of motor subjected to driving.

Each of the H-bridge circuits is configured with four transistors (e.g., FET transistors), to which control signals are inputted. In accordance with the control signal, the four transistors are turned on or off to switch the direction of a current flow so that forward rotation or reverse rotation of the motor is realized.

Referring to FIG. 4, numeral 650 denotes a setting unit for setting the construction of the H-bridges; 651*a*, a controller for controlling the H-bridge 652*a* and the H-bridge 652*b*; and 651*b*, a controller for controlling the H-bridge 652*c* and the H-bridge 652*d*.

In the construction shown in FIG. 4, in a case where the stepping motors (in this embodiment, the maintenance motor M3 and the sheet-feeding motor M4) are driven, the H-bridge 652*a* pairs with the H-bridge 652*b* and the H-bridge 652*c* pairs with the H-bridge 652*d*. In a case where the DC motors (in this embodiment, the carriage motor M1, the conveyance motor M2 and the sheet-discharge motor M5) are driven, in some cases the H-bridges 652*a*, 652*b*, 652*c* and 652*d* independently drive respective motors, and in other cases the H-bridge 652*a* pairs with the H-bridge 652*b* to drive one motor while the H-bridge 652*c* pairs with the H-bridge 652*d* to drive another motor.

In a case of driving a DC motor that does not require a large current (hereinafter referred to as the DCS), the H-bridges 652*a*, 652*b*, 652*c*, and 652*d* can independently drive respective motors. Contrary, in a case of driving a DC motor that requires a large current (hereinafter referred to as the DCL), the H-bridge 652*a* pairs with the H-bridge 652*b*, and the H-bridge 652*c* pairs with the H-bridge 652*d*.

Herein, a specification on the operation of the DC motor is further described. The DCS and the DCL have, for instance, different current values of an initial torque and different peak current values of a varistor. For instance, the current value of an initial torque is 2.5 A in the DCS, but is 3 A in the DCL.

The setting for changing the combination of H-bridges is executed by the controllers 651*a* and 651*b* based on the data set in the setting unit 650.

The setting signal for driving the motor is serially transferred from the ASIC 603 to the setting unit 650. As described later, information transfer from the ASIC 603 to the motor driver 642*a* (642*b*) is performed by utilizing three kinds of serial signal. For this purpose, there are input ports for inputting respective signals in the motor driver 642*a* (642*b*). The setting unit 650 has a serial interface circuit 660 for receiving the serial signal.

Next, several embodiments are described with respect to the serial interface circuit 660 employed in the motor driver of the printer having the above-described construction.

First Embodiment

Figure 5:
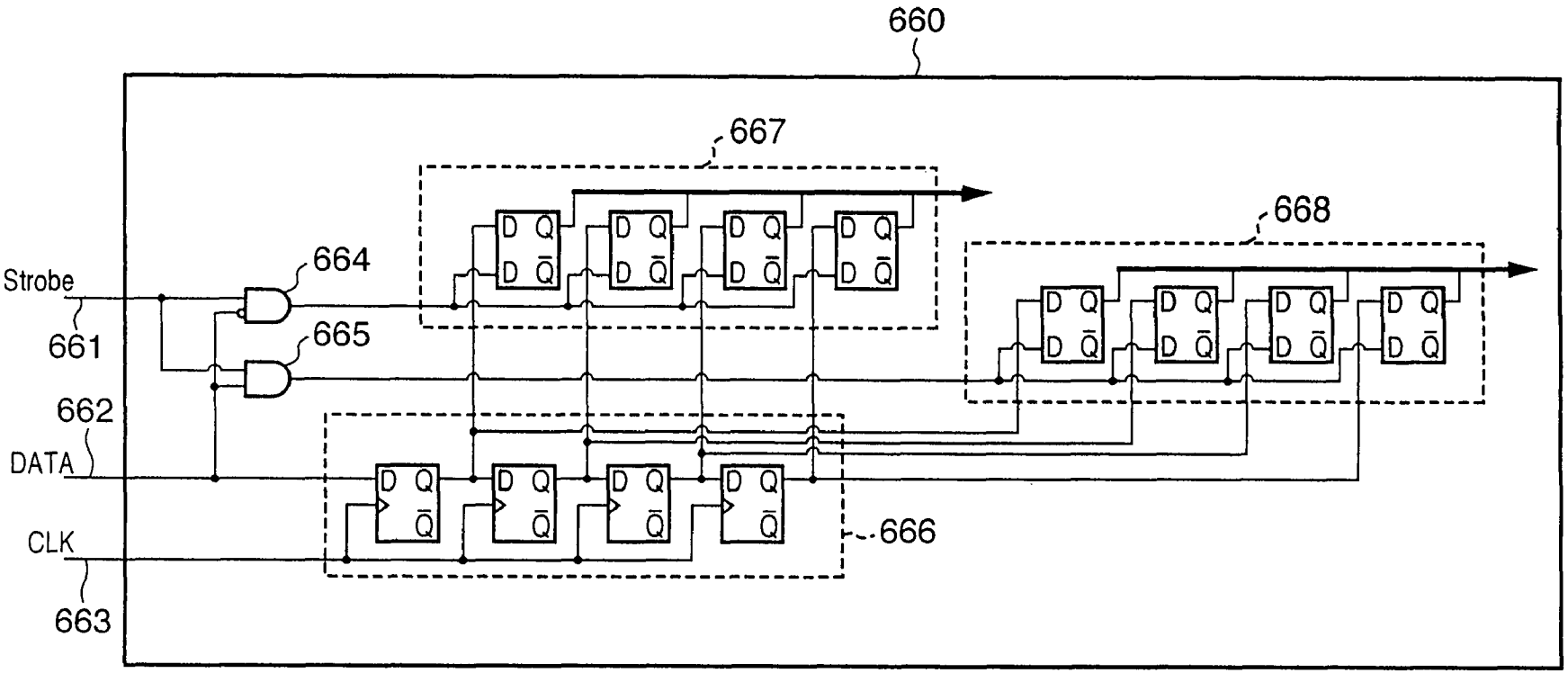
FIG. 5 is a view showing a configuration of a serial interface circuit according to a first embodiment.

FIG. 5 shows a configuration of the serial interface circuit 660 according to the first embodiment.

Three signal lines including: a strobe signal (Strobe) line 661, a data signal (DATA) line 662, and a clock signal (CLK) line 663 are inputted to the serial interface circuit 660. At the time of serial data transfer, the data signal (DATA) which is transferred by the signal line 662 is shifted in synchronization with the clock signal (CLK), thereby inputting the transferred data signal to the flip-flops of the shift register 666.

In this embodiment, in order to simplify the construction of the serial interface circuit, the shift register 666 has 4 bits (i.e., four flip-flop circuits). However, the number of bits may be of 8 bits, 16 bits, 32 bits and so on in accordance with the control bus width of the ASIC 603 transferring the data and the control bus width of the motor driver incorporating the serial interface circuit 660.

Upon completion of the data signal transfer to the shift register 666, a strobe signal (Strobe) is inputted to the signal line 661 to latch the transferred data, thereby enabling the transferred data signal. In this stage, the strobe signal (Strobe) is inputted to the latch 667 through the AND gate 664 and inputted to the latch 668 through the AND gate 665. To the AND gate 665, the data signal (DATA) is inputted from the signal line 662. To the AND gate 664, an inverted data signal (DATA) inverted by the inverter is inputted.

Figure 6:
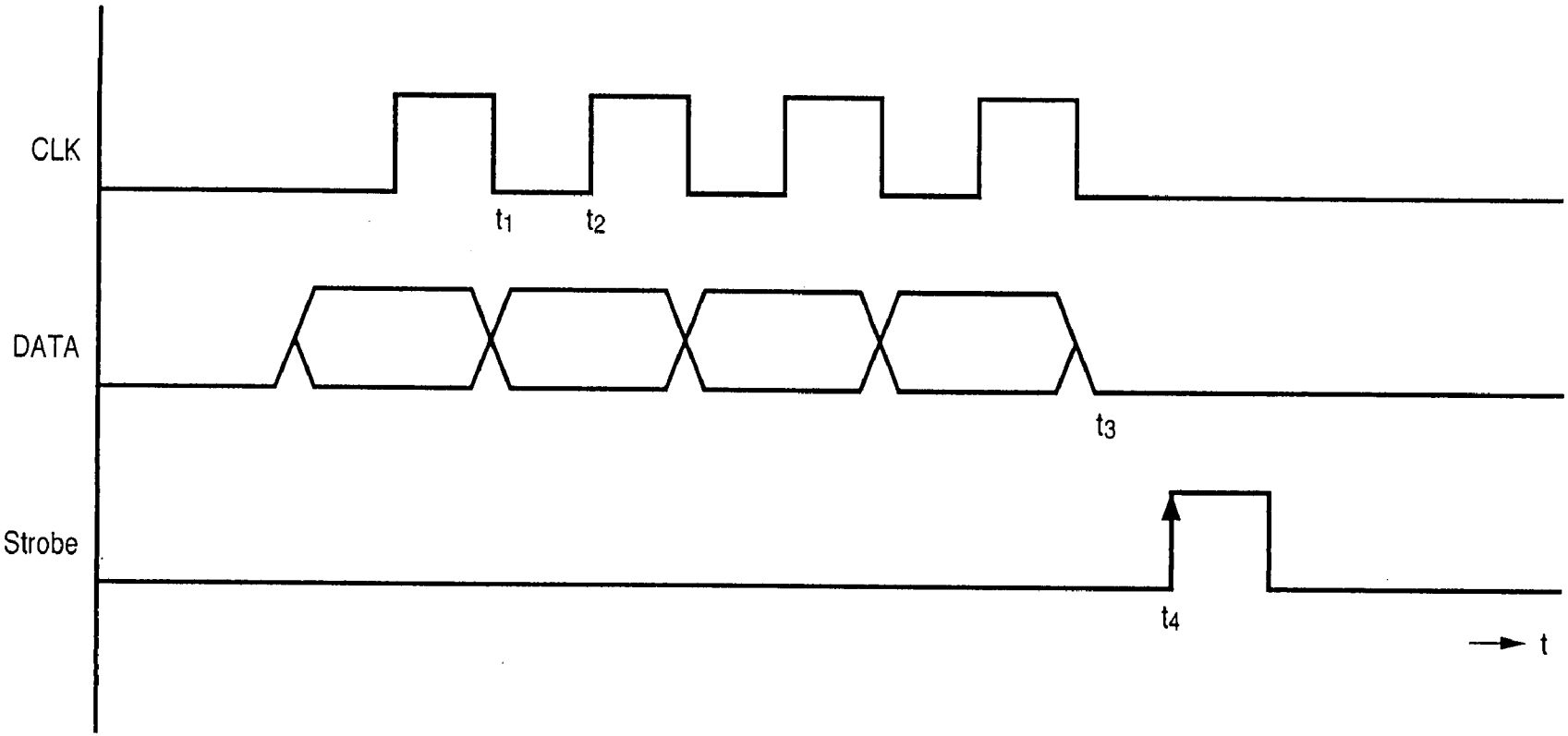
FIG. 6 is a time chart of serially transferred signals for describing an operation of the serial interface circuit shown in FIG. 5.
Figure 7:
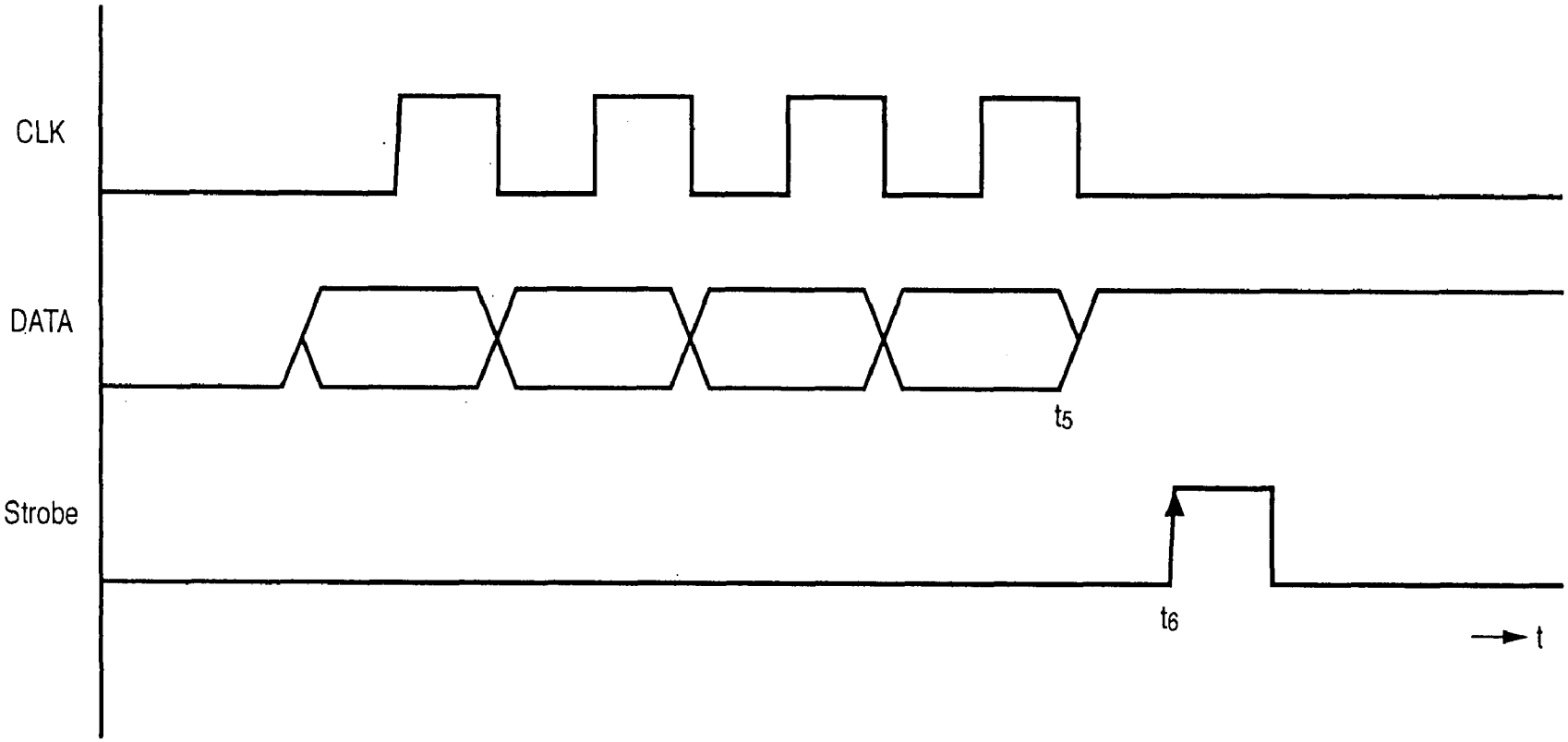
FIG. 7 is another time chart of serially transferred signals for describing an operation of the serial interface circuit shown in FIG. 5.

FIGS. 6 and 7 are time charts of serially transferred signals for describing an operation of the interface circuit shown in FIG. 5.

In FIG. 6, the data signal (DATA) is changed in synchronization with the trailing (e.g., $t=t_1$) of the clock signal (CLK), and the data signal stored in the shift register 666 is shifted in synchronization with the rising (e.g., $t=t_2$) of the clock signal (CLK). After holding a predetermined number of bits (in this embodiment, 4 bits) of data signal (DATA) in the shift register 666, a low-level (Low) data signal (DATA) is outputted ($t=t_3$). In this state, when the strobe signal (Strobe) is generated ($t=t_4$), the strobe signal (Strobe) is inputted from the AND gate 664 to the latch 667 since an inverted data signal inverted by the inverter is inputted to the AND gate 664 and the data signal in the shift register 666 is latched by the latch 667. Meanwhile, since the low-level (Low) data signal (DATA) is inputted to the gate 665, the output of the AND gate 665 is fixed to the low level so that the strobe signal (Strobe) is not inputted to the latch 668.

In FIG. 7, when the data signal is held by the shift register 666 in accordance with the changes in the clock signal (CLK) and the data signal (DATA) as similar to the time chart in FIG. 6, a high-level (High) data signal (DATA) is outputted ($t=t_5$). In this state, although the strobe signal (Strobe) is generated ($t=t_6$), the output of the AND gate 664 is fixed to the low level (Low) since a data signal (DATA) inverted by the inverter is inputted to the AND gate 664. Meanwhile, the strobe signal (Strobe) is inputted from the AND gate 665 to the latch 668 and the data signal in the shift register 666 is latched by the latch 668.

Therefore, according to the above-described embodiment, it is possible to perform data writing in two different latches by using three signals, including the clock signal, the data signal, and the strobe signal, supplied by three signal lines.

Figure 13:
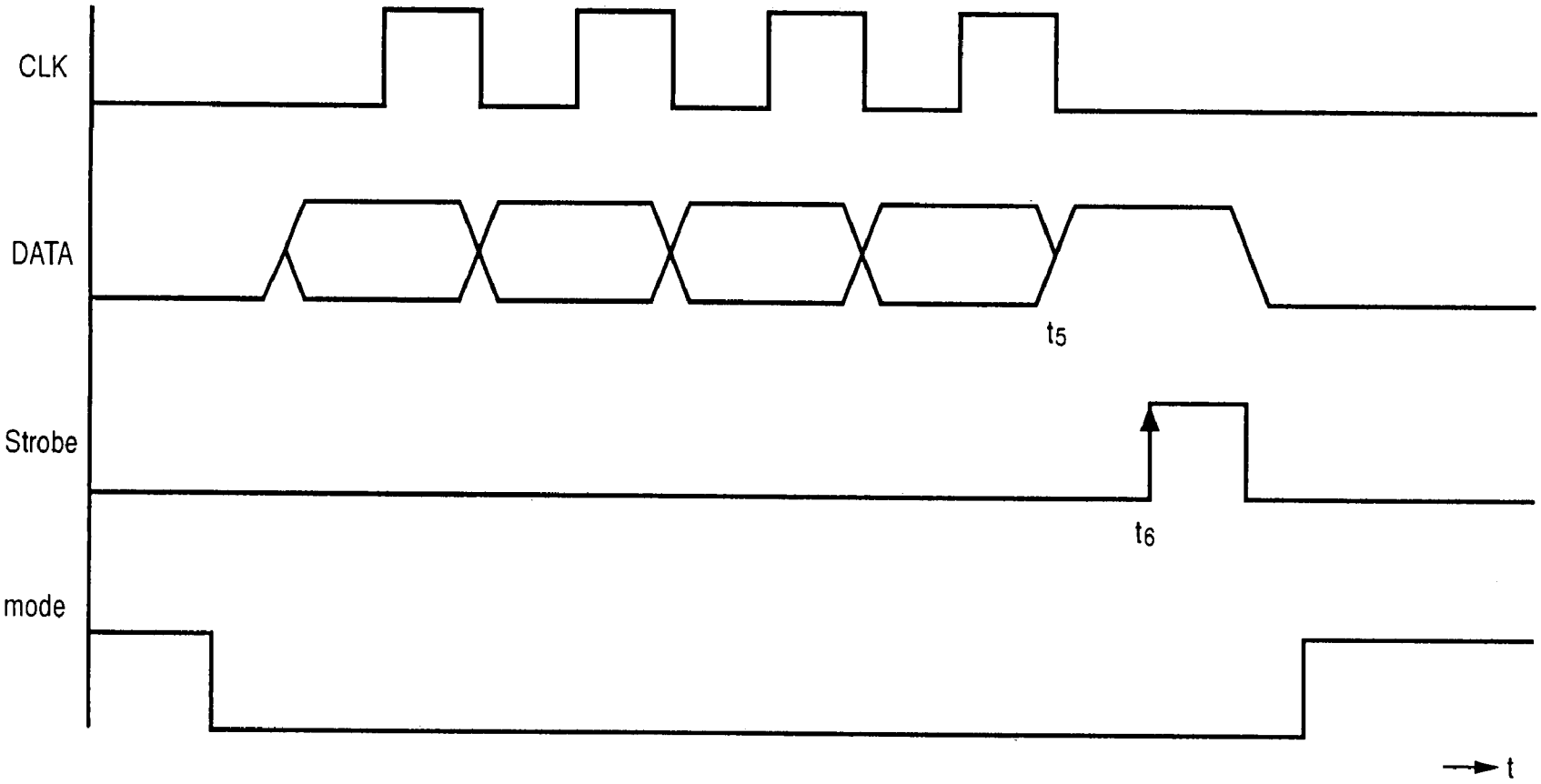
FIG. 13 is another time chart of serially transferred signals for describing an operation of the serial interface circuit shown in FIG. 5.

Note that another signal input port for inputting a mode signal (mode) may be provided to the serial interface circuit 660 to latch data signals by further utilizing a mode signal as shown in FIG. 13. For instance, data signal capturing is performed after the mode signal changes from a high level to a low level.

Second Embodiment

Figure 8:
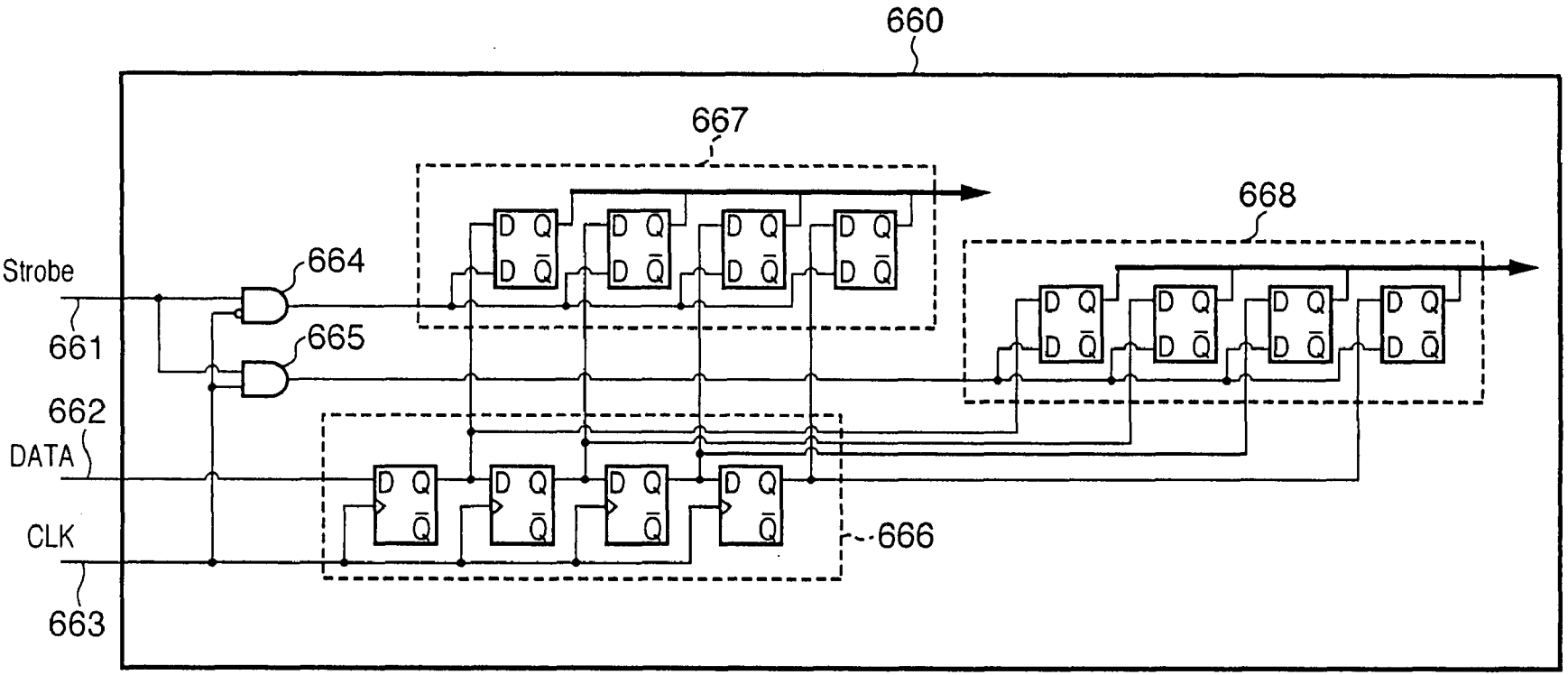
FIG. 8 is a diagram showing a configuration of a serial interface circuit according to a second embodiment.

FIG. 8 shows a configuration of the serial interface circuit 660 according to the second embodiment.

As is apparent from comparing FIG. 8 with FIG. 5, the structural elements constituting the serial interface circuit 660 according to the second embodiment is identical to that of the circuit according to the first embodiment. To these structural elements, the same reference numerals are assigned, and description thereof is omitted.

The difference in the construction of the serial interface circuit between the first embodiment and the second embodiment is described. While in the construction of the first embodiment, the data signal (DATA) and the inverted data signal are respectively inputted to the AND gates 665 and 664, in the second embodiment, the clock signal (CLK) and the inverted clock signal are respectively inputted to the AND gates 665 and 664.

Upon completion of the data signal transfer to the shift register 666, a strobe signal (Strobe) is inputted to the signal line 661 to latch the transferred data signal, thereby enabling the data signal (DATA). In this stage, the strobe signal (Strobe) is inputted to the latch 667 through the AND gate 664 and inputted to the latch 668 through the AND gate 665. To the AND gate 665, the clock signal (CLK) is inputted. To the AND gate 664, an inverted clock signal inverted by the inverter is inputted.

Figure 9:
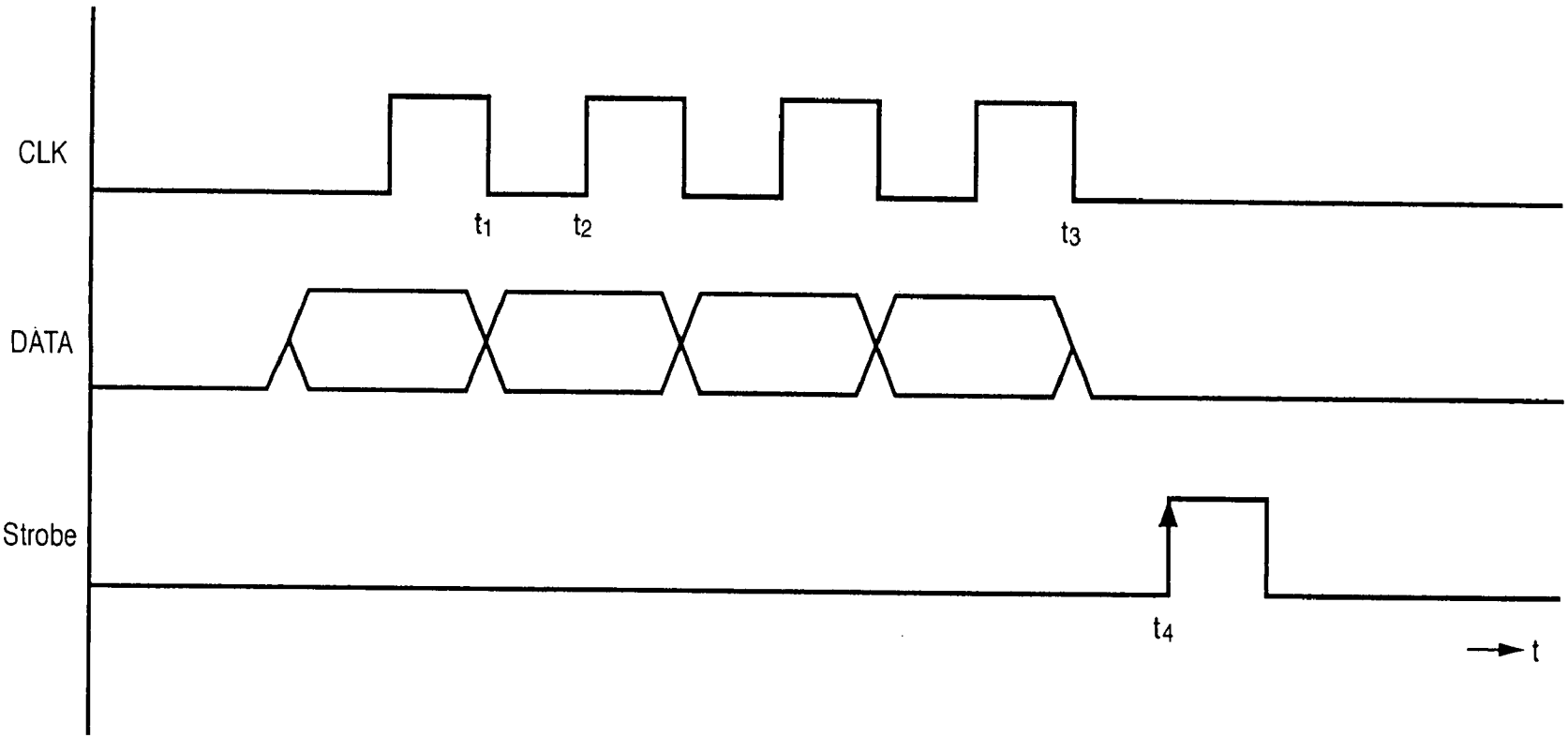
FIG. 9 is a time chart of serially transferred signals for describing an operation of the serial interface circuit shown in FIG. 8.
Figure 10:
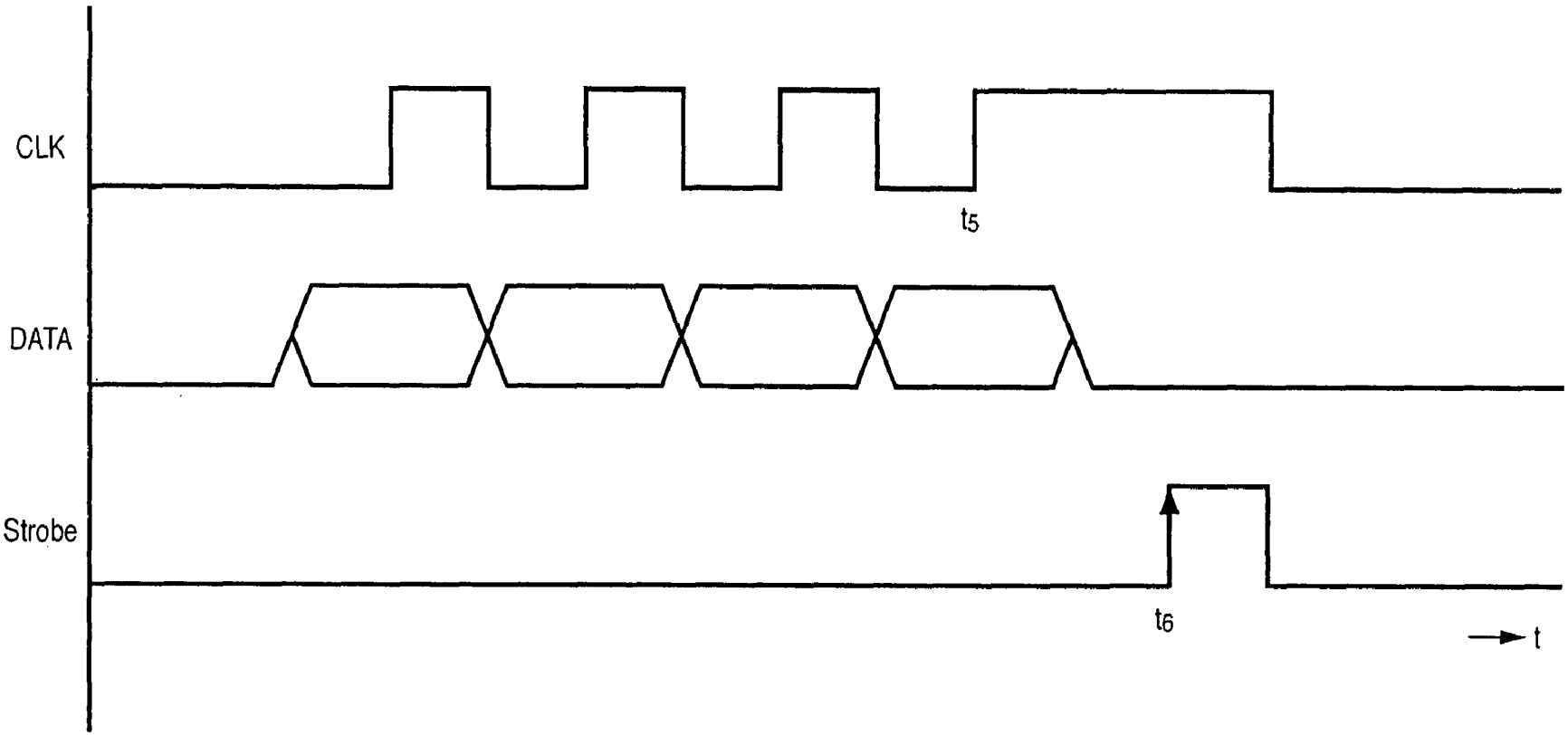
FIG. 10 is another time chart of serially transferred signals for describing an operation of the serial interface circuit shown in FIG. 8.

FIGS. 9 and 10 are time charts of serially transferred signals for describing an operation of the interface circuit shown in FIG. 8.

In FIG. 9, the data signal (DATA) is changed in synchronization with the trailing (e.g., $t=t_1$) of the clock signal (CLK), and the data signal stored in the shift register 666 is shifted in synchronization with the rising (e.g., $t=t_2$) of the clock signal (CLK). After holding a predetermined number of bits (in this embodiment, 4 bits) of data signal (DATA) in the shift register 666, a low-level (Low) clock signal (CLK) is outputted ($t=t_3$). In this state, when the strobe signal (Strobe) is generated ($t=t_4$), the strobe signal (Strobe) is inputted from the AND gate 664 to the latch 667 and the data signal in the shift register 666 is latched by the latch 667 since an inverted clock signal inverted by the inverter is inputted to the AND gate 664. Meanwhile, the output of the AND gate 665 is fixed to the low level so that the strobe signal (Strobe) is not inputted to the latch 668.

In FIG. 10, when the data signal is held by the shift register 666 in accordance with the changes in the clock signal (CLK) and the data signal (DATA) as similar to the time chart in FIG. 9, a high-level (High) clock signal (CLK) is outputted ($t=t_5$). In this state, although the strobe signal (Strobe) is generated ($t=t_6$), the output of the AND gate 664 is fixed to the low level (Low) since a clock signal (CLK) inverted by the inverter is inputted to the AND gate 664. To be more specific, the clock signal (CLK) maintains the high level (High) until the strobe signal (Strobe) changes from a high level (High) to a low level (Low). Meanwhile, the strobe signal (Strobe) is inputted from the AND gate 665 to the latch 668 and the data signal in the shift register 666 is latched by the latch 668.

Therefore, according to the above-described embodiment, it is also possible to perform data writing in two different latches by using three signals, including the clock signal, the data signal, and the strobe signal, supplied by three signal lines. Note that, as has been described with reference to FIG. 13, the mode signal (mode) may be utilized in a way that the clock signal (CLK) is maintained in a high level while the mode signal is in a low level.

Third Embodiment

Figure 11:
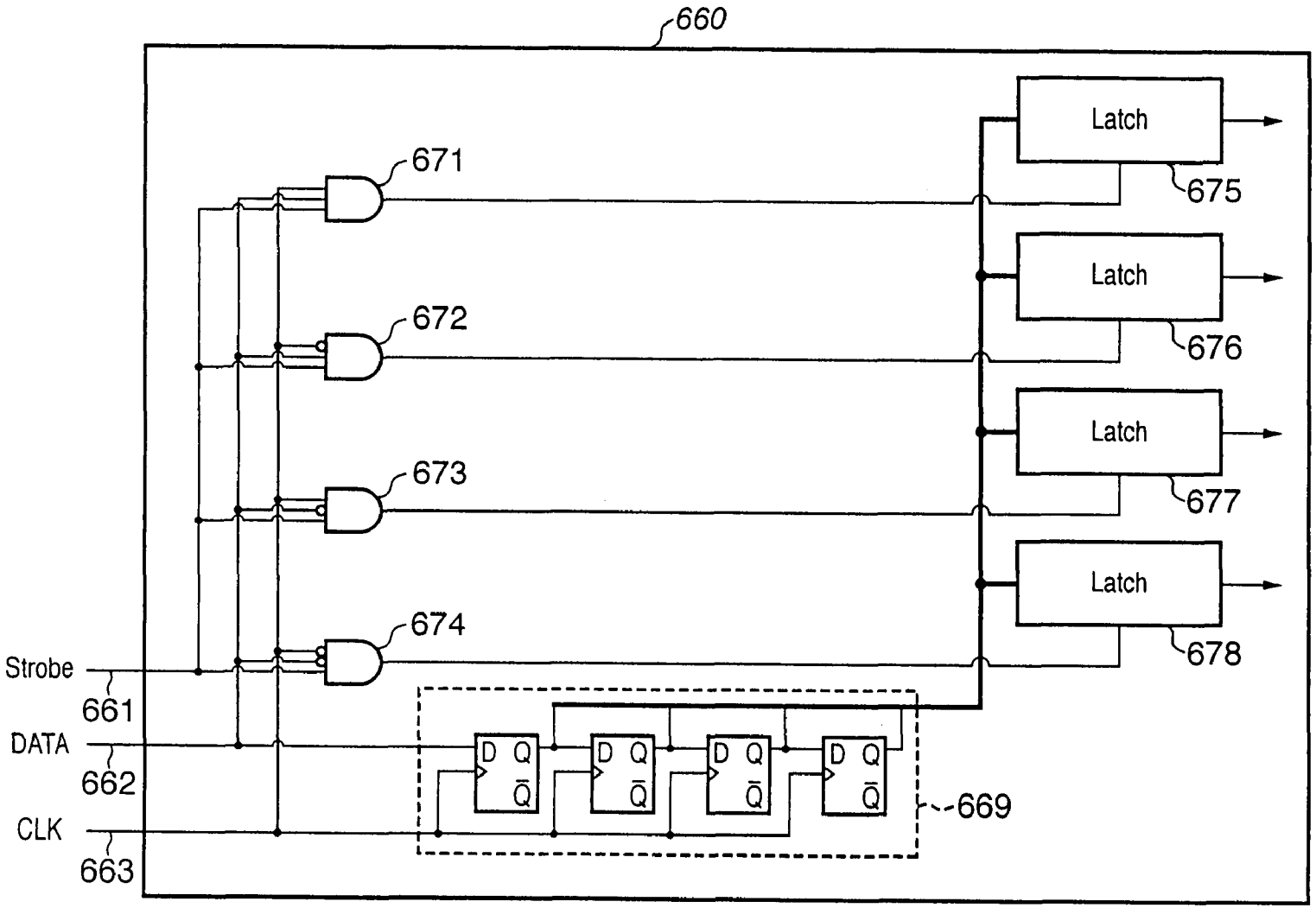
FIG. 11 is a diagram showing a configuration of a serial interface circuit according to a third embodiment.

FIG. 11 shows a configuration of a serial interface circuit according to the third embodiment.

As similar to the first and second embodiments, three signal lines 661 to 663 respectively inputting a strobe signal (Strobe), a data signal (DATA), and a clock signal (CLK) are connected to the serial interface circuit 660 according to this embodiment. At the time of serial data transfer, the data signal (DATA) which is transferred in synchronization with the clock signal (CLK) is shifted and inputted to a shift register 669 constructed with plural flip-flops. The shift register 669 is a 4-bit shift register as similar to the first and second embodiments.

Upon completion of the data signal transfer to the shift register 669, a strobe signal (Strobe) from the signal line 661 is inputted to latch the transferred data signal, thereby enabling the data signal.

As shown in FIG. 11, the strobe signal (Strobe) is inputted to a latch 675 through an AND gate 671, is inputted a latch 676 through an AND gate 672, is inputted a latch 677 through an AND gate 673, and is inputted to a latch 678 through an AND gate 674.

To the AND gate 671, the data signal (DATA) and the clock signal (CLK) are inputted. To the AND gate 672, the data signal (DATA) and an inverted clock signal (CLK) inverted by the inverter are inputted. To the AND gate 673, an inverted data signal (DATA) inverted by the inverter and the clock signal (CLK) are inputted. To the AND gate 674, an inverted data signal (DATA) inverted by the inverter and an inverted clock signal (CLK) inverted by the inverter are inputted.

According to this configuration, assuming a case where a high-level (High) strobe signal (Strobe) from the signal line 661 is inputted, when the data signal (DATA) and the clock signal (CLK) are both in a high level (High), the AND gate 671 allows passing of the strobe signal; when the data signal (DATA) is in a high level (High) and the clock signal (CLK) is in a low level (Low), the AND gate 672 allows passing of the strobe signal; when the data signal (DATA) is in a low level (Low) and the clock signal (CLK) is in a high level (High), the AND gate 673 allows passing of the strobe signal; and when the data signal (DATA) and the clock signal (CLK) are both in a low level (Low), the AND gate 674 allows passing of the strobe signal. Then, the data signal in the shift register 669 is latched by the respective latches connected to the outputs of the respective AND gates.

Therefore, according to the above-described embodiment, it is possible to perform data writing into four different latches, without adding a control signal line, by using three signals including the clock signal, the data signal, and the strobe signal, supplied by three signal lines.

Fourth Embodiment

Figure 12:
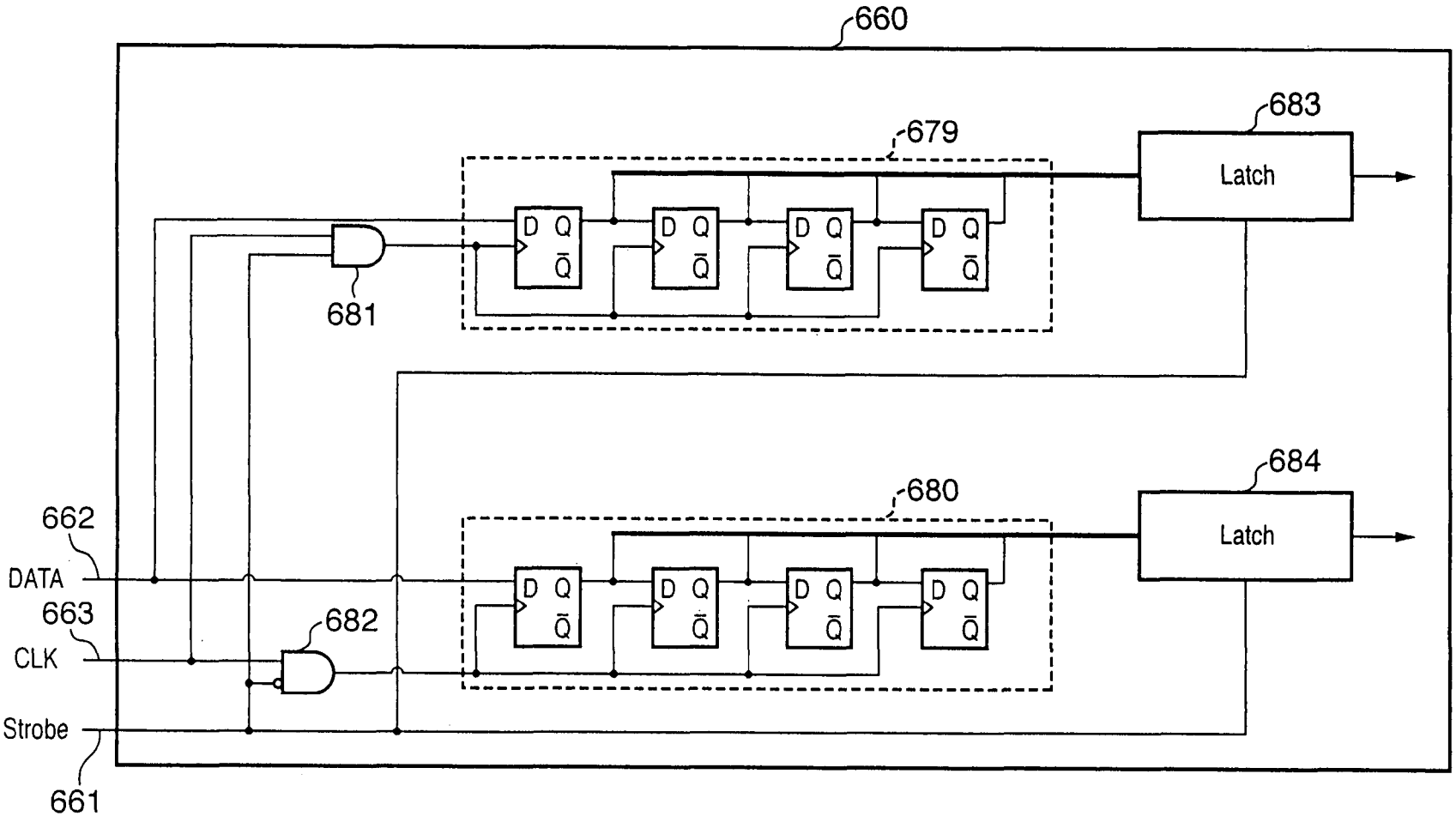
FIG. 12 is a diagram showing a configuration of a serial interface circuit according to a fourth embodiment.

FIG. 12 shows a configuration of a serial interface circuit according to this embodiment.

As similar to the first to third embodiments, three signal lines 661 to 663 respectively inputting a strobe signal (Strobe), a data signal (DATA), and a clock signal (CLK) are connected to the serial interface circuit 660 according to the fourth embodiment.

As shown in FIG. 12, the strobe signal (Strobe) is commonly inputted to latches 683 and 684, and the data signal (DATA) is commonly inputted to shift registers 679 and 680. To an AND gate 681, the clock signal (CLK) and the strobe signal (Strobe) are inputted, and an output of the AND gate 681 is inputted to clocks of the four flip-flops constituting the shift register 679. Meanwhile, to an AND gate 682, the clock signal (CLK) and an inverted strobe signal (Strobe) inverted by the inverter are inputted, and an output of the AND gate 682 is inputted to clocks of the four flip-flops constituting the shift register 680.

According to this configuration, assuming a case where the data signal (DATA) from the signal line 662 is serially transferred in synchronization with the clock signal (CLK) from the signal line 663, when the strobe signal (Strobe) is in a low level (Low), an output signal of the AND gate 681 is fixed to a low level (Low). As a result, in the absence of clock supply, the shift register 679 does not shift the data signal for data transfer. Meanwhile, the clock signal (CLK) is outputted as it is from the AND gate 682, and the shift register 680 receiving the clock supply can capture the serially transferred data signal (DATA).

In the mean time, when the strobe signal (Strobe) is in a high level (High), the clock signal (CLK) is outputted as it is from the AND gate 681, and the shift register 679 receiving the clock supply can capture the serially transferred data signal (DATA). Meanwhile, an output signal of the AND gate 682 is fixed to a low level (Low). As a result, in the absence of clock supply, the shift register 680 does not shift the data signal for data transfer.

Thereafter, when the strobe signal (Strobe) is inputted from the signal line 661, the data signal of the shift register 679 is latched by the latch 683, while the data signal of the shift register 680 is latched by the latch 684. Note that the data signal in the shift register that did not receive the clock supply is basically the same as the data signal that has previously been latched. In other words, since the data signal substantially identical to the previous signal is latched upon the strobe signal input, no operational problem arises.

Therefore, according to the above-described embodiment, it is possible to latch respective data of two different shift registers at the same time (input of one strobe signal) by using three signals including the clock signal, the data signal, and the strobe signal, supplied by three signal lines.

According to any of the configurations in the above-described four embodiments, it is possible to perform various data writing into latches by using three signals including a clock signal, a data signal, and a strobe signal, supplied by three signal lines. Therefore, with a slight modification in the configuration of the serial interface circuit and a slight modification in the signal transmission sequence from the ASIC side, it is possible to flexibly deal with various controls without changing the type of signals or the number of signal lines for serial transfer between the ASIC and the motor drivers.

In accordance with data signals captured in the foregoing manner, various setting is performed on the motor drivers. In accordance with the setting, the printer is able to perform driving control of the five motors for which DC motors and stepping motors are employed.

From the aspect of an overall printer, this invention leads to realization of various motor driving controls with minimum changes in designs and specifications, and contributes to a reduced development cost, use of standardized components, and a minimized wiring area of the serial signal lines on a circuit board.

Note in the above-described embodiments, although the description has been provided on a printer that performs printing with an inkjet printhead as an apparatus comprising a motor driver, the present invention is not limited to this, but may be applied to other apparatuses (e.g., facsimile, copying machine or the like) where plural motors are driven.

Furthermore, the construction of the motors adopted by the printer is not limited to the above-described embodiments, but may be of a construction where the sheet-discharge motor M5 is used also as the conveyance motor M2 to reduce the number of motors incorporated in the printer, or a construction where a DC motor is used as the maintenance motor.

Furthermore, the above-described serial interface circuit is also applicable to serial transfer between a printhead and a head driver. For instance, if this serial interface circuit is applied to the circuit configuration of a printhead, plural latch control signals are not necessary in data writing using plural latches; consequently dedicated pads become unnecessary. Therefore, it contributes to realization of complicated printing control without increasing the number of control signal lines, i.e., the number of wires in an FPC.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-113214 filed on Apr. 7, 2004, the entire contents of which are incorporated herein by reference.

What is claimed is:

1. A serial data transfer method of serially transferring a data signal from a first electric device to a second electric device in synchronization with a clock signal and a strobe signal, the data signal being supplied from the first electric device to the second electric device using a first signal line, the clock signal being supplied from the first electric device to the second electric device using a second signal line, and the strobe signal being supplied from the first electric device to the second electric device using a third signal line, the method comprising:

an input step of:

i. inputting a first portion of the data signal, corresponding to a predetermined number of bits of the data signal, to a shift register of the second electric device in synchronization with the clock signal, ii. inputting a second portion of the data signal, having a predetermined signal level, to the second electric device after the first portion of the data signal is supplied from the first electric device to the second electric device, and iii. inputting the strobe signal to a logic circuit when or after the second portion of the data signal is supplied from the first electric device to the second electric device; and a capturing step of selectively capturing the first portion of the data signal inputted to the shift register by a first latch or a second latch of a plurality of latches, where the first latch and the second latch are connected to the shift register in parallel, based on a result of a logical operation of a signal level in the strobe signal and the predetermined signal level in the second portion of the data signal by the logic circuit when or after the strobe signal is supplied from the first electric device to the second electric device, wherein the predetermined signal level is either a high level or a low level.

2. An electric device for serially receiving a data signal supplied from an external device using a first signal line in synchronization with a clock signal supplied from the external device using a second signal line and a strobe signal supplied from the external device using a third line, comprising:

a shift register in which a first portion of the data signal, corresponding to a predetermined number of bits of the data signal, is inputted in synchronization with the clock signal;

a plurality of latches configured to selectively capture the first portion of the data signal inputted to said shift register by inputting a second portion of the data signal, having a predetermined signal level, to the electric device after the first portion of the data signal is supplied from the external device, and by inputting the strobe signal to the electric device via a logic circuit when or after the second portion of the data signal is supplied from the external device; and a capture control circuit for selectively capturing the first portion of the data signal inputted to said shift register by a first latch or a second latch of said plurality of latches, based on a result of a logical operation of a signal level in the strobe signal and the predetermined signal level in the second portion of the data signal by the logic circuit when or after the strobe signal is supplied from the external device, wherein the first latch and the second latch are connected to the shift register in parallel, and wherein the predetermined signal level is either a high level or low level.

3. The device according to claim 2, wherein said capture control circuit performs control in such a way that the data signal inputted to said shift register is selectively captured by a first latch or a second latch of said plurality of latches based on the control signal and a signal level change in the clock signal after the clock signal has been inputted.

4. The device according to claim 2, wherein said capture control circuit performs control in such a way that the data signal inputted to said shift register is selectively captured by a first latch, a second latch, a third latch, or a fourth latch of said plurality of latches based on the control signal, a signal level change in the data signal after the data signal has been inputted, and a signal level change in the clock signal.

5. The device according to claim 2, further comprising a second shift register for inputting the data signal in synchronization with the clock signal, wherein said capture control circuit performs control in such a way that the first portion of the data signal, supplied from the first signal line, is inputted to said shift register or said second shift register in accordance with the strobe signal, and in accordance with a control signal further inputted upon the data signal input, said capture control circuit performs control in such a way that the first portion of the data signal inputted to said shift register or said second shift register is selectively captured by the first latch or the second latch of said plurality of latches.

6. A printing apparatus incorporating the electric device according to claim 2, comprising:

scanning means for reciprocally scanning a printhead that performs printing on a print medium, feed means for feeding the print medium into the printing apparatus;

conveyance means for conveying the print medium according to a progress of a printing operation;

discharge means for discharging the print medium outside the printing apparatus upon completion of the printing operation;

maintenance means for maintaining operation of the printhead;

driving means for supplying a driving force for respectively driving said scanning means, said feed means, said conveyance means, said discharge means, and said maintenance means;

driving control means for controlling said driving means; and control means for controlling the printing apparatus, wherein the electric device is incorporated as part of said driving control means, and a driving control data signal, used by said driving control means, is supplied to said electric device by serial transfer from said control means.

7. The apparatus according to claim 6, wherein said driving means includes:

a carriage motor for driving a carriage, to which the printhead is mounted, which reciprocally moves;

a feed motor for feeding the print medium into the printing apparatus;

a conveyance motor for conveying the print medium;

a discharge motor for discharging the print medium outside the printing apparatus; and a maintenance motor for performing recovery, cleaning, and capping of the printhead.

8. The apparatus according to claim 6, wherein said driving control means is a motor driver, said control means includes an ASIC, and a motor driving data signal is serially transferred from the ASIC to the motor driver.

9. An electronic device comprising:

a first circuit unit; and a second circuit unit, wherein a first signal line supplying a data signal, a second signal line supplying a clock signal, and a third signal line supplying a strobe signal are provided between said first and second circuit units, and said second circuit unit includes:

a shift register in which a first portion of the data signal, corresponding to a predetermined number of bits of the data signal, is inputted in synchronization with the clock signal;

a plurality of latches configured to selectively latch the first portion of the data signal inputted to the shift register by inputting a second portion of the data signal, having a predetermined signal level of the data signal, to the second circuit unit after the first portion of the data signal is supplied from the first circuit unit, and by inputting the strobe signal to the second circuit unit via a logic circuit when or after the second portion of the data signal is supplied from the first circuit unit; and a control circuit for selecting from the plurality of latches a latch for latching the first portion of the data signal inputted to the shift register, based on a result of a logical operation of a signal level in the strobe signal and the predetermined signal level in the second portion of the data signal by the logic circuit when or after the strobe signal is supplied from the first circuit unit, wherein a first latch and a second latch of the plurality of latches are connected to the shift register in parallel, and wherein the predetermined signal level is either a high level or a low level.

10. The device according to claim 9, wherein said first circuit unit is a circuit for controlling the electronic device, and said second circuit unit is a driver circuit for driving a given load.

11. The device according to claim 10, wherein the given load is a plurality of motors, and the data signal is serially transferred from said first circuit unit to said second circuit unit.

* * * * *